United States Patent [19]

Sapkus et al.

[11] 4,355,482

[45] Oct. 26, 1982

[54] SKATING DOLL

[75] Inventors: Jurgis Sapkus, Manhattan Beach; J. Stephen Lewis, Pacific Palisades; Toshio Yamasaki, Long Beach, all of Calif.

[73] Assignee: Mattel, Inc., Hawthorne, Calif.

[21] Appl. No.: 210,454

[22] Filed: Nov. 26, 1980

[51] Int. Cl.[3] ..... A63H 11/00; A63H 30/04

[52] U.S. Cl. ..... 46/106; 46/254

[58] Field of Search ..... 46/103, 104, 105, 150, 46/254, 264, 265, 266

[56] References Cited

U.S. PATENT DOCUMENTS

| | | | |
|---|---|---|---|
| 2,698,497 | 1/1955 | Müller | 46/206 X |
| 3,038,275 | 6/1962 | Curci | 46/266 |
| 3,103,762 | 9/1963 | Glass et al. | 46/264 X |

FOREIGN PATENT DOCUMENTS

| | | | |
|---|---|---|---|
| 413551 | 5/1946 | Italy | 46/105 |
| 2027349 | 2/1980 | United Kingdom | 46/254 |

*Primary Examiner*—F. Barry Shay

*Attorney, Agent, or Firm*—Reagin & King

[57] ABSTRACT

A roller skating doll is disclosed. The doll has a roller skate attached to each foot, and the skates are in turn driven by motors positioned in the adjoining legs. The legs and one foot of the doll are articulated and may be secured in various positions so that the doll may skate on both legs or skate balanced on one leg. A skate may be fixed in different steering positions so that the doll may progress forward or in a circle. The skate drive motors are remotely controlled and are energized alternately in a fashion that emulates the movements of a human roller skater. An alternate embodiment is also disclosed which permits the skates to be removed from the doll.

2 Claims, 8 Drawing Figures

SKATING DOLL

BACKGROUND OF THE INVENTION

This invention relates to dolls and, more particularly, to a remotely controlled skating doll. There have been any number of dolls produced for children. Many of these dolls have been capable of performing various mechanical functions such as walking. For example, U.S. Pat. No. 3,465,473, issued Sept. 9, 1969 to T. Nakamura, U.S. Pat. No. 3,604,147, issued Sept. 14, 1971 to E. Ceccon, U.S. Pat. No. 3,038,275, issued June 12, 1962 to A. Curci, all disclose walking dolls of various sorts including dolls which move on wheels which are driven by motors. However, no known prior art doll is capable of emulating the motions of a human child roller skating.

The typical body motions of a child roller skating on two legs include a rotational motion, in addition to the forward motion of the child. The child accelerates by alternately pushing the skate on one foot while gliding on the other, causing the child's body to rotate toward the left and right as the child moves forward. In addition to this normal skating motion, a child on roller skates is able to skate on one leg by lifting one leg off of the ground and shifting its body weight over the other leg to maintain balance. In this position, the skater may steer in a straight path or in a circular, pirouette fashion.

It is accordingly an object of this invention to provide a new and improved doll.

It is another object of this invention to provide a new and improved roller skating doll.

It is an additional object of this invention to provide a remotely controlled roller skating doll capable of emulating the movements of a human roller skater.

SUMMARY OF THE INVENTION

The foregoing and other objects and features of the invention are accomplished by a doll having a roller skate on each foot, each roller skate being driven by a motor positioned in the adjoining leg. The driving motors may in turn be remotely controlled. The extremities of the doll may be articulated and secured in various positions so that the doll may be made to balance and skate on one or both legs as does a human. Various arrangements also allow different steering positions so that the doll may progress forwardly, in a circle to the right or to the left.

In one embodiment, the driving motors for the skates are coupled to the skates by a unique slip clutch drive mechanism so that the skates may be removed from the doll.

Other objects, features, and advantages of the invention will become apparent from a reading of the specification when taken in conjunction with the drawings in which like reference numerals refer to like elements in the several views.

DESCRIPTION OF THE PREFERRED EMBODIMENT

Figure 1:
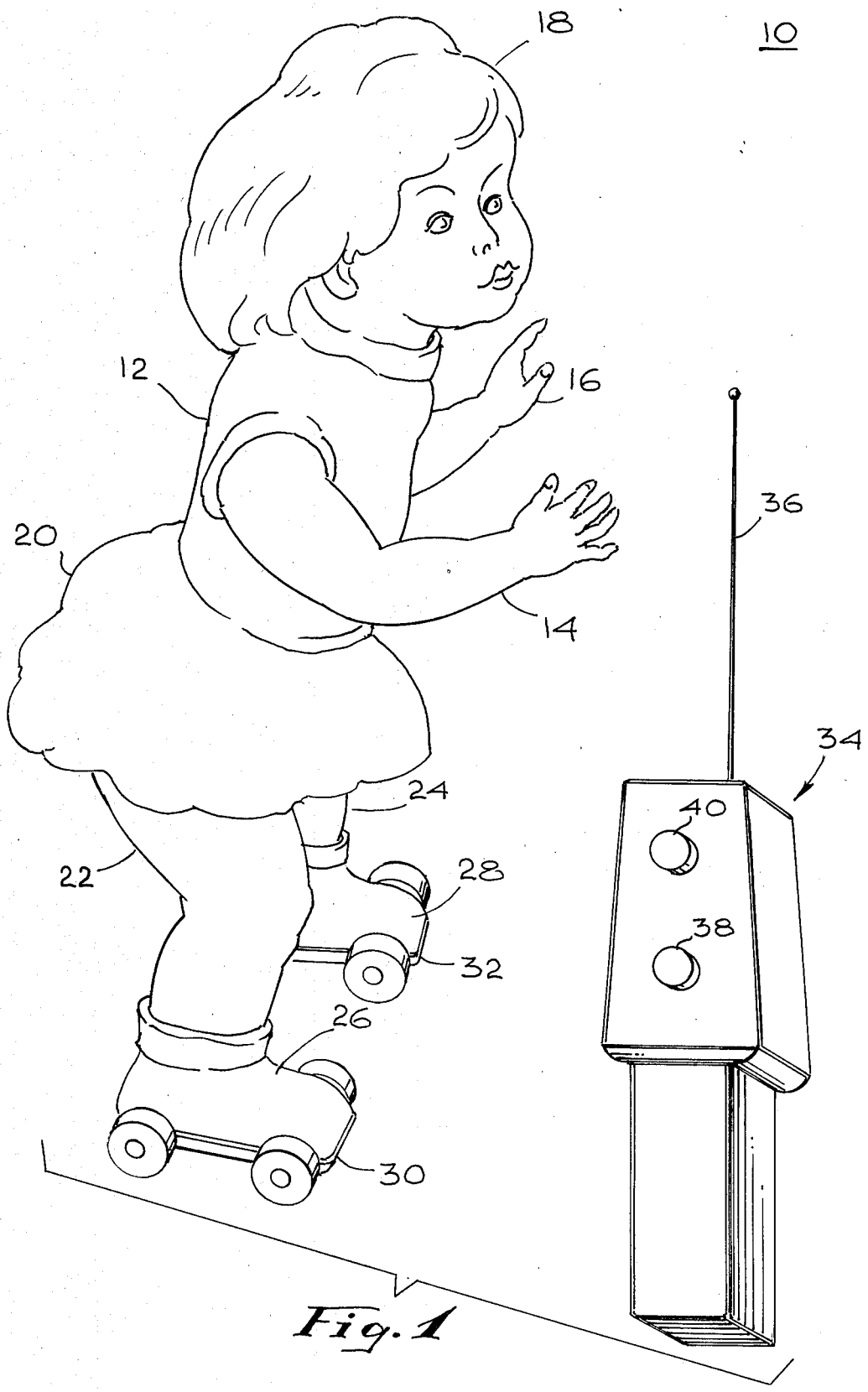
FIG. 1 is a perspective view of a skating doll constructed in accordance with the invention.

Referring now to the drawings and, more particularly, to FIG. 1, there is shown a skating doll 10 constructed in accordance with the invention. The doll 10 has a body 12, a pair of arms 14 and 16 and head 18 supported on the body 12. The doll 10 may also be provided with a skirt 20 or other fanciful dress to create a more realistic skating doll. A pair of legs 22 and 24 are also attached to the body 12, the legs 22 and 24 further having foot portions 26 and 28 depending therefrom. The doll 10 also has a pair of roller skates 30 and 32 each of which is connected to be operated by a motor (not shown in FIG. 1) positioned in the foot 26 or 28 or leg 22 or 24 to which the skate is attached. As will also be explained hereinafter, the doll 10 is provided with means for positioning each of its legs 22 and 24 so that it may balance on but a single leg 22. Consequently, the doll 10 may be made to skate on both skates 30 and 32 together or upon only the skate 30.

Associated with the doll 10 is a remote control transmitter unit 34 having an antenna 36, an on button 38 and a select button 40. Residing in the doll 10, although not shown in FIG. 1, is a remote control receiver unit having an antenna; the receiver unit is connected to motors in each leg of the doll 10.

The remote control transmitter 34 and the receiver may be types well known in the art and the construction thereof will not be described in detail. As will be described hereinafter, the receiver is connected to motors in each foot 26 and 28 and is adapted to energize either one or the other of the motors in the following manner. Pressing the button 38 starts the motor in the doll's left leg 24, pressing button 40 at the same time that the button 38 is depressed disconnects the left motor and starts the motor in the right leg 22. Consequently, by depressing the button 38 and alternately pressing and releasing the select button 40, first one motor and then the other may be energized to produce a skating motion.

Figure 2:
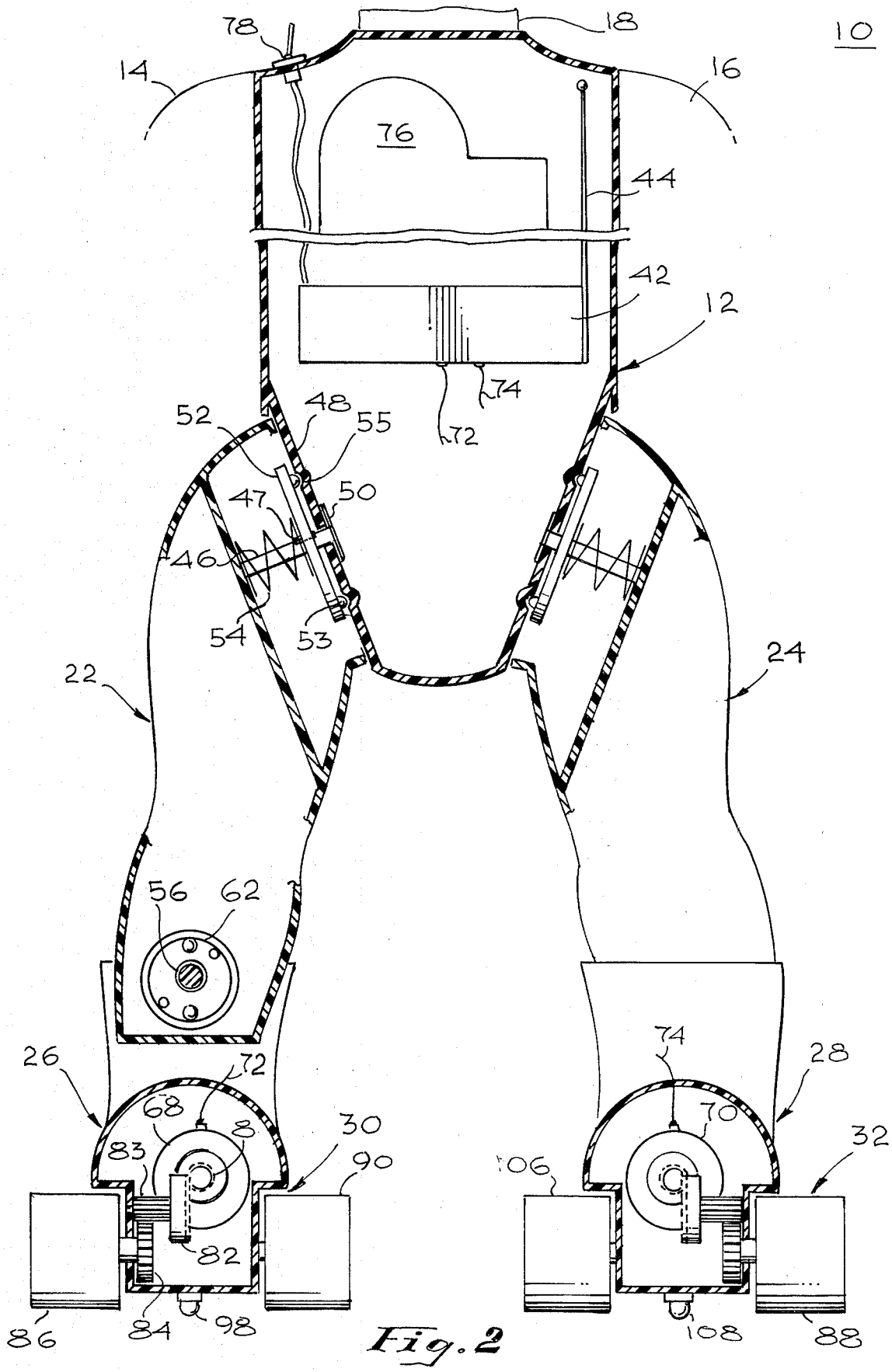
FIG. 2 is a front internal schematic view of a skating doll constructed in accordance with the invention.
Figure 3:
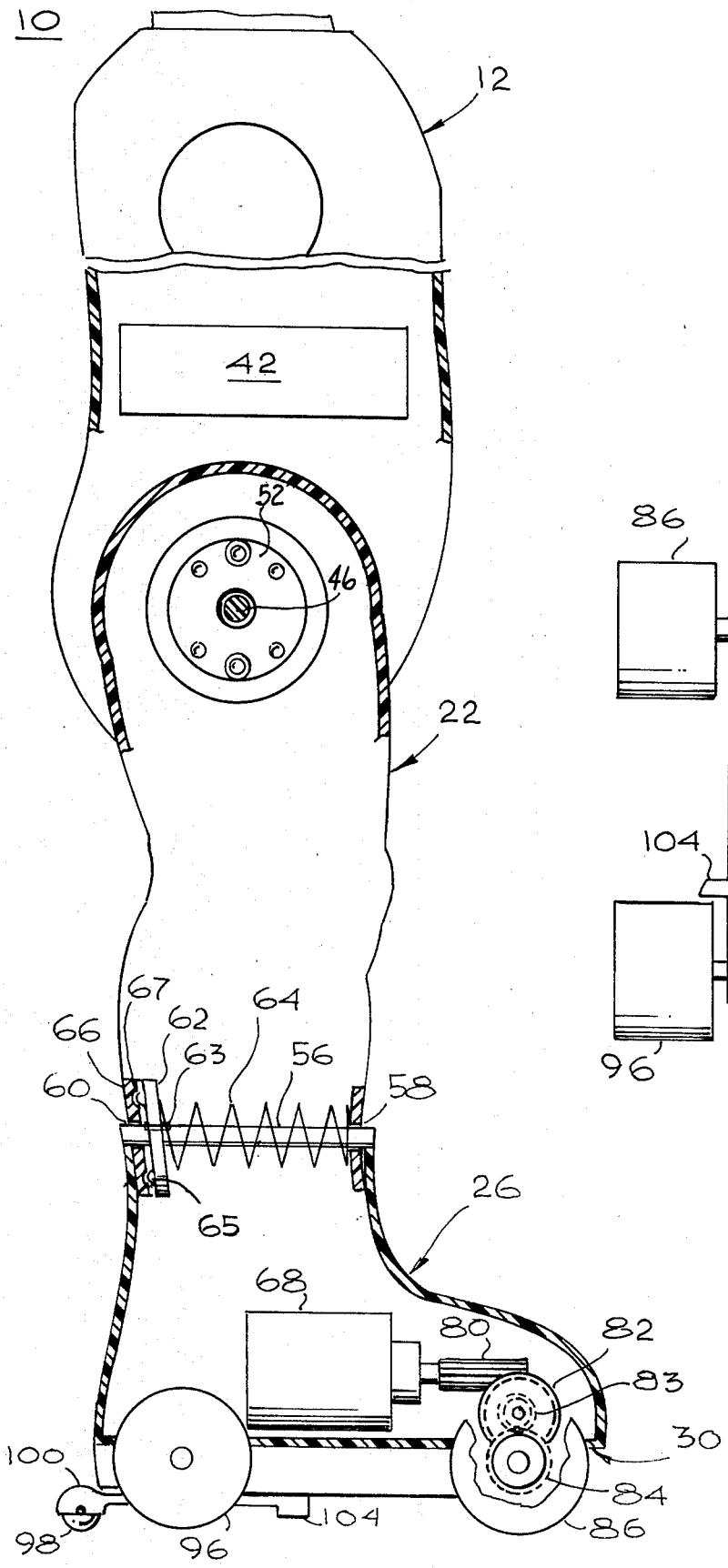
FIG. 3 is a side, partially schematic view of the doll shown in FIG. 2.

Referring now to FIGS. 2 and 3 there are shown front, cross-sectional, and side views partially cut away of the doll 10 shown in FIG. 1. The body 12, the arms 14 and 16 and the head 18 may all be constructed of a molded plastic material in a manner well known in the prior art. The head 18 may be rotatably supported on the body 12, and the arms 14 and 16 may be rotatably attached to the body 12 so that the user may orient the head and arms to simulate a realistic roller skating position. Also shown in FIG. 2 is a remote control receiver 42 positioned within the body 12. The receiver 42 has an antenna 44 positioned to receive signals from the transmitter 34 shown in FIG. 1.

The legs 22 and 24 which may be constructed of a well known moldable plastic material are rotatably mounted to the body 12 on opposite sides. This mounting is accomplished in each case by an assembly comprising a leg axle 46 which is generally cylindrical in shape and is affixed to the leg 22 or 24. The axle 46 projects through an opening in a wall 48 affixed to the body 12. The axle 46 is retained to the wall 48 by a flange 50 fixed to one end of the axle 46. A detent disk 52 is slidably mounted on the axle 46 and is prevented from rotating about the axle 46 by means such as a key way 47 in the axle 46. A spring 54 is positioned around the axle 46 and exerts pressure on the detent disk 52 to hold it in place against the wall 48. The wall 48 in turn contains recesses 55 to accept the detents 53 on the detent disk 52. Consequently, the leg 22 or 24 may be rotated about the leg axle 46 to a series of fixed positions controlled by the placement of the detents. The detents lock the leg with respect to the body 12 at these fixed positions so that the doll 10 may be balanced on one leg as described hereinafter.

A similar rotational mounting system with detent locking action is provided to couple the right foot 26 to the right leg 22 of the doll 10. As shown in FIG. 3, the foot 26 is provided with an axle 56 which projects through apertures 58 and 60 of the leg 22 to rotatably mount the foot 26. The axle 56 is mounted parallel to the skating surface of the skate 30. A detent disk 62 is slidably mounted on the axle 56 and is prevented from rotating about the axle 56 by means such as a key 63. A spring 64 is positioned about the axle 56 and exerts pressure to hold detents 65 on the detent disk 62 against a wall 66 of the leg 22. The wall 66 is provided with recesses 67 to mate with the detents 65 on the detent disk 62. Consequently, the foot 26 may be rotated about an axis parallel to the skating plane of the skate 30. As described hereinafter the rotational coupling of the foot 26 to the leg 22 permits shifting the weight of the doll 10 to achieve a balance over the skate 30 so that the doll 10 may skate on a single leg 22.

As is shown in FIG. 2, the receiver 42 is connected to a pair of motors 68 and 70 by conductors 72 and 74 respectively. The motors 68 and 70 and the receiver 42 are powered by batteries which may be inserted through a battery compartment 76 as shown in FIG. 2. Also provided is an on-off power switch 78 mounted to the body 12. As explained above, the motors 68 and 70 are alternately operated by the transmitter 34. The motors 68 and 70 may be any of the number of types well known to the prior art. For example, a pair of Mabuchi RE260-18130 DC motors positioned as shown in FIGS. 2 and 3 are adapted to provide sufficient power for operating the doll 10. Each motor 68 and 70 provides output at a spur gear 80 which is transferred by drive gear 82 via spur gear 83 to output gear 84 which drives the front outer wheel 86 of the skate 30. In like manner, a gear train is provided in the left foot 28 to drive the front outer wheel 88 of the skate 32.

Figure 4:
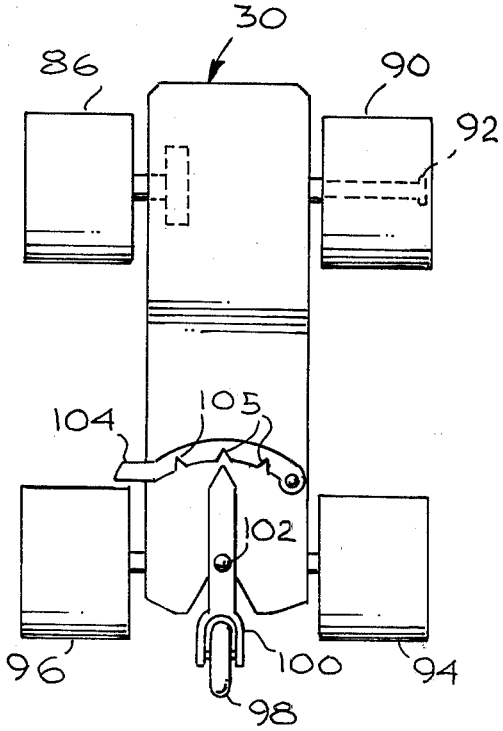
FIG. 4 is a bottom view of a roller skate shown in FIGS. 2 and 3.

FIG. 4 is a view of the bottom of the right hand skate 30 shown in FIG. 2. As described above the front outer wheel 86 is the driven wheel. The front inner wheel 90 is free to rotate about an axle 92. The rear wheels 94 and 96 of the skate 30 are rigidly attached to the skate 30 and are not designed to rotate. Instead, the rear of the skate 30 is supported by a single caster wheel 98 mounted to a frame 100 which is affixed to rotate about a pivot point 102 on the base of the skate 30. The caster frame 100 may be free to swivel about point 102 or may be locked into any one of a number of positions by moving a locking bar 104 into position. As shown in FIG. 4, the locking bar 104 has a series of recesses 105 designed to lock the frame 100 into fixed positions, creating a pivoting action of the doll 10 as described hereinafter.

As shown in FIG. 3 the caster wheel 98 is positioned below the bottom surface of the rear wheels 94 and 96 of the skate 30. Thus only the front wheels 86 and 90 and the rear caster 98 contact a smooth surface. In an analogous manner, the skate 32 attached to the left leg 24 as shown in FIG. 2 also has a freely rotating inner front wheel 106 and a rear mounted caster wheel 108. The rear wheels (not shown) of the skate 32 are also rigidly attached to the skate 32 and are not designed to contact the surface. The operation of the skating doll 10 thus described is as follows.

Assume that the user wishes to operate the doll 10 as though it were skating on both legs 22 and 24. The legs 22 and 24 would be rotated about their rotational joints so that the legs 22 and 24 were aligned under the body 12. In like manner, the foot 26 of the right leg 22 would be rotated so that the skate 30 and the skate 32 were aligned to travel on a parallel surface. The result would be a doll 10 in a position as shown in FIG. 1. In addition, the caster wheel 98 of the right skate 30 would be allowed to pivot freely about pivot point 102 by moving the lock 104 as shown in FIG. 4 to a position which disengages it from the frame 100. The user of the toy would then energize the receiver circuitry by turning on the switch 78.

By operating the button 38 of the transmitter 34 the motor 70 in the left foot 28 is energized rotating the wheel 88 of skate 32. Since the motor 68 in the right skate 30 is not energized, the wheel 86 which is coupled to the motor 68 via a fixed gear train acts as a drag on the right skate 30. Thus the wheel 88, being driven by motor 70, causes the doll 10 to move forward on leg 24 and rotate to the right, pivoting about the skate 30. By subsequently depressing the button 40 on the transmitter 34 as described above, the motor 70 is deenergized and the motor 68 is energized. Thus, the right leg begins moving forward; and, since the motor 70 is not moving, it acts as a drag upon the skate 32, and the doll moves forward and tends to rotate to the left. In this manner, the doll may be made to proceed forward impelled by first one skate and then the other in a motion which realistically emulates both the forward and the rotational movements of a human child roller skating. To enhance the rotational motion of the doll 10, the outside diameter of the freely rotating inner front wheels 90 and 106 of the skates 30 and 32 may be made slightly smaller than the outside diameter of the driven outer front wheels 86 and 88 respectively. Accordingly, when the doll 10 is balanced on both legs 22 and 24, only the outer front wheels 86 and 88, and the rear caster wheels 98 and 108 contact the surface, and permit a greater freedom of rotation of the doll 10.

By depressing the button 38 of the transmitter 34 with the thumb and alternately depressing and releasing the button 40 of the transmitter 34, the child may cause the doll to effectively skate along a given path. When it is desired to have the doll return to the user, releasing button 40, and thus keeping only the left leg 24 energized, causes the doll 10 to rotate to the right. When the doll 10 is properly oriented in the reverse direction, the skating action can be recommenced by pushing button 40, and the doll can be made to return. Obviously, the length of time the button 40 is depressed and released effects the amount of rotation of the doll 10; and this length of time may be varied by the user to simulate different skating patterns.

When it is desired to have the doll 10 skate only on one leg 22, the user may rotate the other leg 24 upward and to the rear using the rotational motion and the detents 53 as described above. To offset this shift in center of gravity caused by raising the leg 24, the user may then rotate the body 12 in the forward direction about the rotational joint of leg 22. Thus the center of gravity of the doll 10 can be made to shift forward and back and be centered above the leg 22 and the skate 30. In addition, the center of gravity can be shifted from the left to the right to center it above the skate 30 in this plane by rotating the doll about the rotational axle 56 coupling the leg 22 to the foot 24. Thus, the leg 22 in FIG. 2 may be shifted to the left to shift the weight of the doll 10 above the skate 30.

Figure 5:
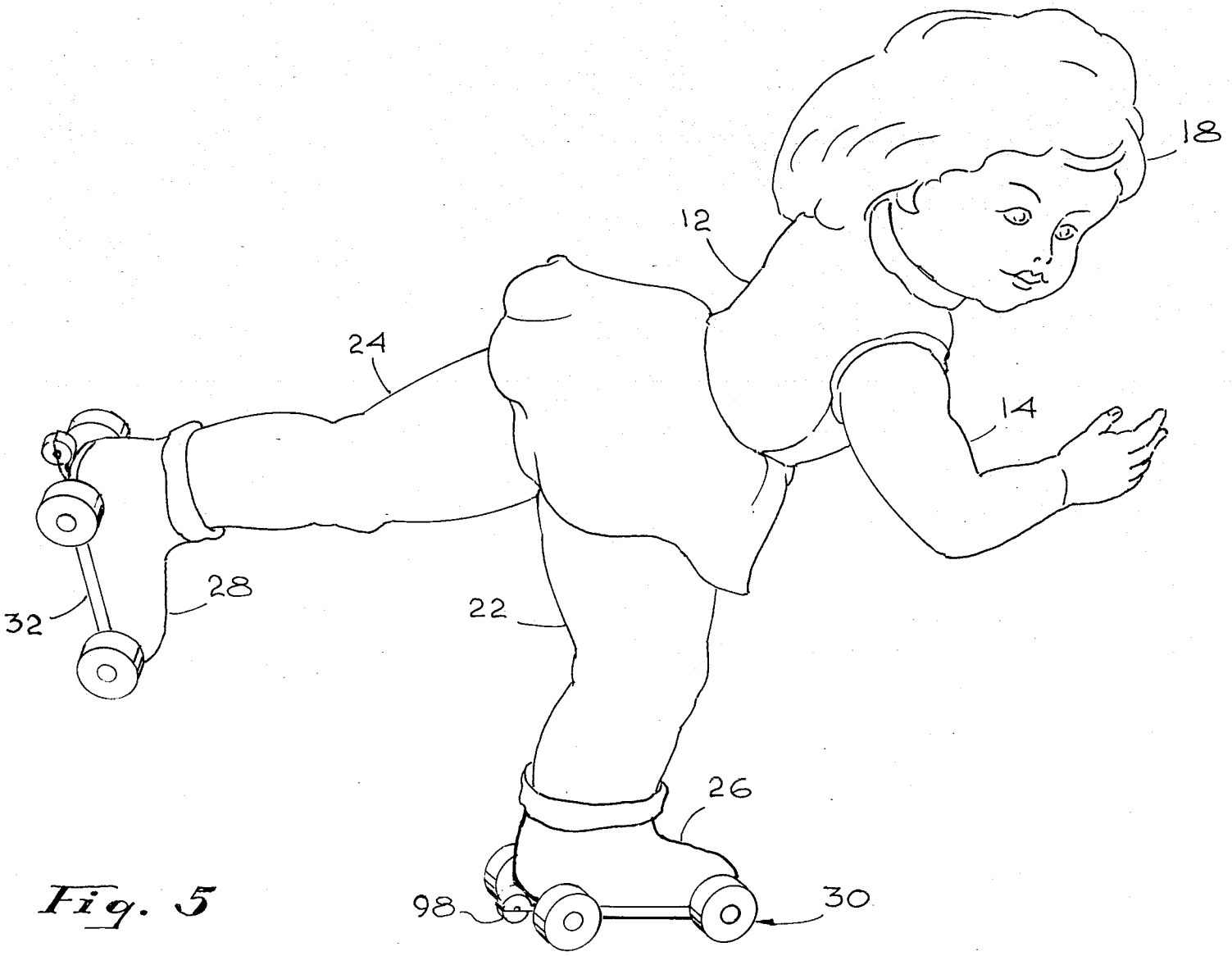
FIG. 5 is another perspective view of a skating doll constructed in accordance with the invention and showing the doll in a position for skating on one leg.

The result is to place the doll 10 into the position as shown in FIG. 5 where the center of gravity of the body is in line with the skate 30 balancing the doll over the skate 30. The locking detents 53 and 65 at the leg-to-body rotational joints and the leg-to-foot joint of the right foot 26, respectively, ensure that the user can quickly place the doll 10 in a balanced position about the skate 30, the detent positions being chosen to ensure that the doll is balanced.

In the embodiment in which the diameter of the inner front wheel 90 is slightly less than the diameter of the outer front wheel 86, the skate 30 cants slightly, supporting the doll 10 on the three wheels 86, 90, and 98. The user may choose to lock the rear caster wheel 98 of the skate 30 into a position off-center either to the right or to the left by using the locking means 104 as shown in FIG. 4. By actuating the buttons 38 and 40 of the transmitter 34, the outer front wheel 86 of skate 30 will be driven. Depending on the position of the caster wheel 98, the doll 10 will pirouette on one leg in circles either clockwise or counterclockwise. Thus the doll 10 may be made to simulate the actions of a child roller skating on one leg.

In an alternate embodiment of the invention, means are provided so that the skates 30 and 32 may be removed from the doll to further emulate a human skater. The features of the alternate embodiment are shown in FIGS. 6 and 7 which are similar to FIGS. 2 and 3 with the following distinctions.

Figure 6:
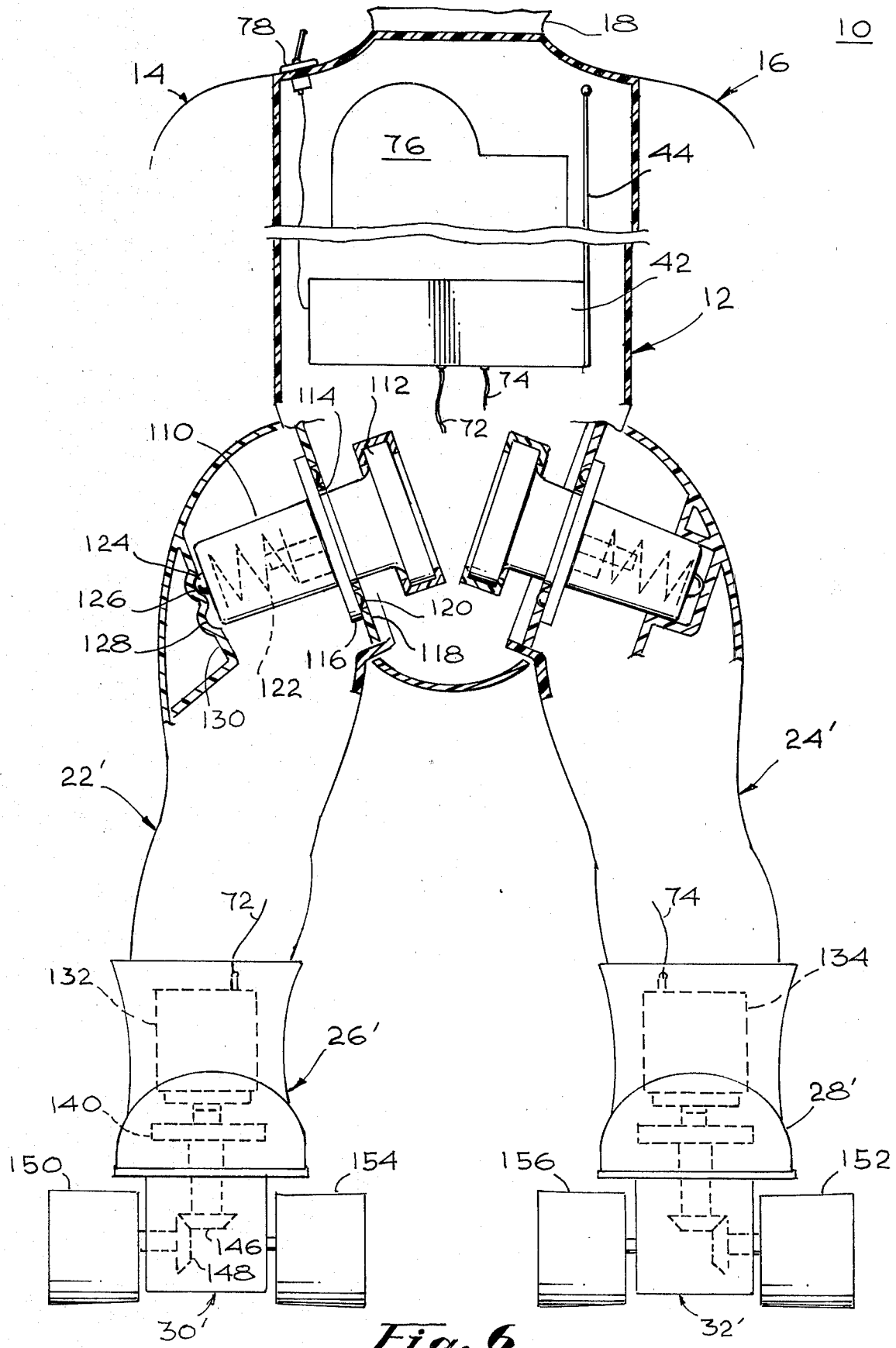
FIG. 6 is a front internal schematic view of an alternate embodiment of the skating doll constructed in accordance with the invention.
Figure 7:
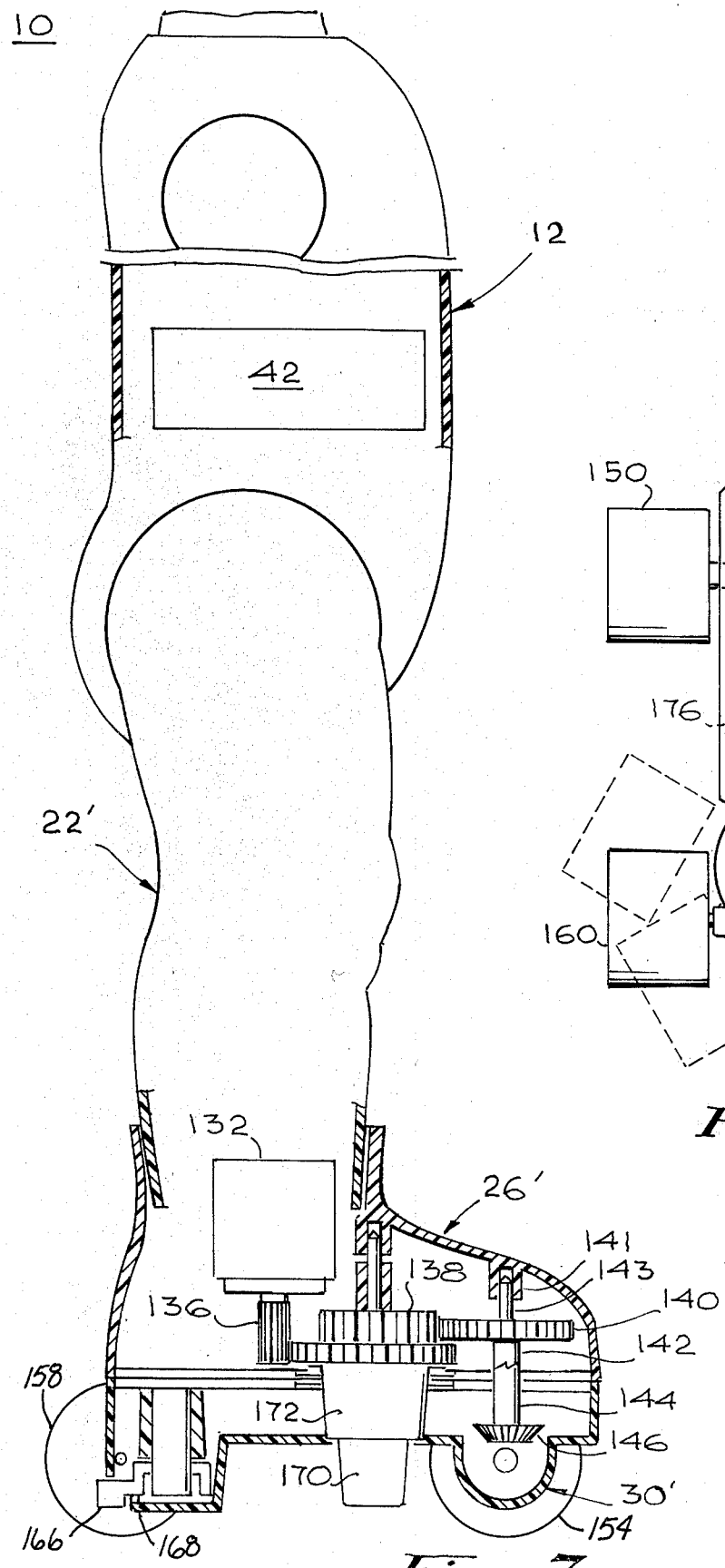
FIG. 7 is a side, partially schematic view, of the doll shown in FIG. 6.

As shown in FIG. 6, the legs 22' and 24' are rotatably mounted to the body 12 in each case by an assembly comprising a leg axle 110 which is generally cylindrical in shape and has a flange 112 at its larger end. The leg axle 110 is positioned with its flange end 112 within the body 12 of the doll 10 and projects through an aperture 114 within the upper end of the leg 22' or 24'. A detent disk 116 positioned within the upper interior of the leg 22' or 24' bears against a wall 118 having aperture 114 therein through which the leg axle 110 projects. A spring 122 is positioned within the interior of the leg axle 110 and exerts pressure to hold the detent disk 116 in place against the wall 118. In the case of the leg 22' only, the leg axle 110 has an extending knob 124 at the outer extreme end thereof which is adapted to fit into two recess positions 126 and 128 in a wall 130 within the leg 22'.

As is shown in FIG. 6, the detent disk 116 is held in place by the spring 122 so that the leg 22' (or the leg 24') remains in position once placed therein. Consequently, the leg 22' or 24' may be rotated about the leg axle 110 in a manner analogous to the embodiment described above. Furthermore, in the leg 22' the detent projection 124 may be positioned in the higher position 126 or the lower position 128 so that the doll is balanced with a single leg 22' touching the ground. For example, by rotating the leg 22' upwardly and moving the projection 124 into the lower position 128, the body 12 and head 18 of the doll 10 are moved over the leg 22'. Thus, if the leg 24' is rotated so that it is off the ground, the center of mass of the doll 10 will be moved over the leg 22' so that it may balance upon that leg alone. Consequently, the adjustments necessary to balance the doll 10 on one leg 22' in this embodiment are all accomplished at the hips, where the legs 22' and 24' join the body 12. This is in contract to the previous embodiment where the adjustments occurred at the hips and at the ankle of the leg 22.

As in the first described embodiment, the receiver 42 is connected to a pair of motors 132 and 134 by conductors 72 and 74. As explained above, the motors 132 and 134 may be alternately operated by the transmitter 34. As shown in FIG. 7, each motor 132 and 134 provides output at a spur gear 136 which is transferred by a drive gear 138 to operate an output gear 140. Rotation of the gear 140 rotates a lower shaft 142 which has an inclined-tooth gear surface on the bottom thereof. Gear 140 is rotationally supported in a bearing 141 which receives upper shaft 143 of the gear 140. The gears 136, 138, 140, and shaft 142 are all contained within the feet 26' and 28' connected to the legs 22' and 24', respectively. The inclined-tooth gear surface of the shaft 142 is coaxial with and adapted to mate with a second inclined-tooth gear surface on a shaft 144 with a bevel gear 146. As shown in FIG. 6, the gear 146 is aligned at right angles to a second bevel gear 148 which drives the outer forward wheel 150 of the skate 30' attached to the foot 26'. An identical motor-gear train assembly is provided to drive the outer forward wheel 152 of the skate 32' attached to the foot 28'. The gears 146 and 148 are all contained within the skate sections 30' and 32'. The inner front wheels 154 and 156 are attached to the skates 30' and 32' to rotate freely.

Figure 8:
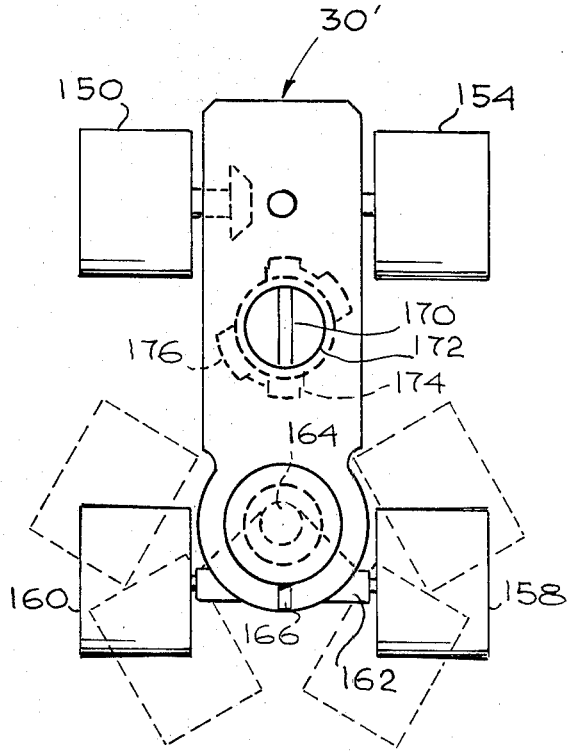
FIG. 8 is a bottom view of a roller skate shown in FIGS. 6 and 7.

FIG. 8 is a view of the bottom of the right-hand skate 30' shown in FIG. 6. The wheel 150 is the driven wheel of the skate 30' while the wheels 158 and 160 are freely rotating wheels. The wheels 158 and 160 are connected on an axle 162 which rotates about a pivot point 164 on the base of the skate 30' and may be fixed in any one of a number of positions from the center position shown in FIG. 8 to the two dotted positions shown in the same figure. The wheels 158 and 160 may be fixed in position by a lock 166, as shown in FIG. 7. The lock 166 is rotatably mounted about the pivot point 164, between the axle 162 and a surface of the skate housing 168, as shown in FIG. 7. The surface 168 is inclined, so that rotation of the lock 166 wedges it between the axle 162 and the surface 168, locking the axle 162 into position.

A feature of this embodiment is that the skates 30' and 32' may be removed from the feet 26' and 28' by manipulation of a lock which is adapted to connect the skates 30' and 32' to the feet 26' and 28'. Such a lock is shown in FIG. 8 in a first and a second position. The lock comprises a manual turning device 170 for rotating a cylindrical member 172 which has projections 174 adapted to fit into the base of the foot 26' through apertures 176 therein. When rotated, the projections 174 clamp tightly against the bottom of the foot 26' thereby securing the skates 30' and 32' to the feet 26' and 28'. The locking device allows the skates 30' and 32' to be removed to more accurately emulate a human skater.

The removal of the skates 30' and 32' is enhanced by the meshing mechanism provided by the inclined-tooth gear surfaces on the shafts 142 and 144. These surfaces are adapted to easily pull apart but provide drive motion when the skates 30' and 32' are positioned to the feet 26' and 28'. For example, assume the gear surfaces of the shafts 142 and 144 are not in the proper position for meshing when the skate 30' is attached to the foot 26'. As shown in FIG. 7, there is sufficient play provided in the bearing 141 which supports the upper shaft 143 of the gear 140 to permit the gear 140 to move up into the foot 26' to accomodate the misaligned gear surfaces of the shafts 142 and 144 and permit attaching the skate 30' to the foot 26'. When the drive motor 132 is subsequently energized, the gear 140 will rotate until the inclined-tooth gear surface on shaft 142 meshes with the gear surface on shaft 144, providing drive motion to the skate wheel 150. When the skates 30' and 32' are removed, the bottom surfaces of the feet 26' and 28' are flat so that the doll 10 may stand. This flat surface is achieved because the shaft 142 and the locking apertures 176 are recessed below the bottom surfaces of the feet 26' and 28'.

In the previous embodiment, as explained above, each one of the skates 30' and 32' is operated alternately by depressing the buttons 38 and 40 on the transmitter 34. One of the motors 132 or 134 will be actuated and the doll 10 with move forward impelled by the driving wheel of that skate. Since the other motor is not moving, it will act as a drag upon the other skate and cause the doll to turn in the direction of the undriven skate. This action may be emphasized by positioning the wheels 158 and 160 through use of the wheel locking device 166.

By adjusting the legs of the doll 10 by using the rotational motion of the leg bearings 110 thereof and the positioning of the projection 124 as explained above, the doll 10 may be positioned to skate on one leg 22' in relatively tight circles. The tightness of the circle is of course controlled by the angle at which the following wheels 158 and 160 are set by means of the locking apparatus 166.

While the invention is disclosed and particular embodiments thereof are described in detail, it is not intended that the invention be limited solely to these embodiments. Many modifications will occur to those skilled in the art which are within the spirit and scope of the invention. It is thus intended that the invention be limited in scope only by the appended claims.

What is claimed is:

1. A skating doll comprising in combination:

a body including a head and a pair of arms;

a pair of legs;

means for pivotably attaching the legs to the body;

a pair of feet;

means for attaching each said foot to the lower end of a respective leg;

a skate affixed to the bottom of each foot, each skate having at least three spaced apart wheels rotatably mounted thereon;

drive means operatively coupled to each skate and located adjacent each skate for driving at least one of the skate wheels;

means for powering the drive means for each skate, and in which the means for pivotably attaching the legs to the body includes means rotatably coupling the upper ends of the legs to the lower portion of the body about an axis oriented so that the legs may be rotated toward the front or rear of the body, and which further includes leg detent means for locking the legs in predetermined rotational positions relative to the body, and the means for attaching the feet to the legs includes means rotatably coupling the upper end of at least one said foot to the lower end of the adjoining leg about an axis parallel to the skating surface and oriented so that the one foot may be rotated thereabout toward the left or right of the body, and which further includes foot detent means for locking the one foot in predetermined rotational positions relative to the adjoining leg, whereby rotating the legs and the one foot of the skating doll to the predetermined positions allows the doll to balance on the one foot.

2. A skating doll comprising in combination:

a body including a head and a pair of arms;

a pair of legs;

means for pivotably attaching the legs to the body;

a pair of feet;

means for attaching each said foot to a respective leg, including means for pivotably attaching at least one foot to the lower end of the adjoining leg;

a skate affixed to the bottom of each foot, each skate having at least three spaced apart wheels rotatably mounted thereon;

drive means operatively coupled to each skate and located adjacent each skate for driving at least one of the skate wheels;

means for powering the drive means for each skate, and in which each of the roller skates includes inner and outer rotatably mounted front wheels and a rear caster wheel rotatably mounted to a frame which is pivotably mounted to the skate, and in which at least one of the skates further includes means for locking the caster wheel frame to the skate in a plurality of positions, so that the skates may be made optionally to travel in straight or circular paths.

* * * * *